US010490937B1

(12) United States Patent
Su et al.

(10) Patent No.: US 10,490,937 B1
(45) Date of Patent: Nov. 26, 2019

(54) HIGH-SPEED PUSH-PULL SELF-LOCK CONNECTOR AND CONNECTOR ASSEMBLY

(71) Applicants: NEXTRONICS ENGINEERING CORP., New Taipei (TW); SINBON Electronics Co., Ltd., Jiangyin, Jiangsu (CN)

(72) Inventors: Hou-An Su, Keelung (TW); Yong Zhang, Guangdong (CN); Zun-Zun Hu, Jiangsu (CN); Wei Sun, Jiangsu (CN)

(73) Assignees: NEXTRONICS ENGINEERING CORP., New Taipei (TW); SINBON ELECTRONICS CO., LTD., Jiangyin, Jiangsu (CN)

( * ) Notice: Subject to any disclaimer, the term of this patent is extended or adjusted under 35 U.S.C. 154(b) by 0 days.

(21) Appl. No.: 16/297,528

(22) Filed: Mar. 8, 2019

(30) Foreign Application Priority Data

Dec. 17, 2018 (CN) ..... 2018 1 1541360

(51) Int. Cl.

| | |
|---|---|
| ***H01R 13/629*** | (2006.01) |
| ***H01R 13/639*** | (2006.01) |
| ***H01R 13/502*** | (2006.01) |
| ***H01R 24/40*** | (2011.01) |
| ***H01R 13/64*** | (2006.01) |
| ***H01R 24/64*** | (2011.01) |
| ***H01R 4/48*** | (2006.01) |

(52) U.S. Cl.
CPC ..... *H01R 13/629* (2013.01); *H01R 4/48* (2013.01); *H01R 13/502* (2013.01); *H01R 13/639* (2013.01); *H01R 13/64* (2013.01); *H01R 24/40* (2013.01); *H01R 24/64* (2013.01)

(58) Field of Classification Search
CPC .. H01R 13/629; H01R 13/639; H01R 13/502; H01R 13/64; H01R 24/40; H01R 24/64
See application file for complete search history.

(56) References Cited

U.S. PATENT DOCUMENTS 4,429,938 A * 2/1984 Flor ..... H01R 13/625 403/349
4,508,407 A * 4/1985 Ball ..... H01R 13/622 439/312

(Continued)

*Primary Examiner* — Briggitte R. Hammond
(74) *Attorney, Agent, or Firm* — Li & Cai Intellectual Property (USA) Office

(57) ABSTRACT

A high-speed push-pull self-lock connector includes a first plastic core, a plurality of first terminals, a plurality of second terminals, a first shielding shell, a first housing, and a locking member. The first terminals and the second terminals are disposed through the first plastic core. The first shielding shell covers and is disposed outside the first terminals and the second terminals. The first housing is disposed outside the first plastic core. The first terminals, the second terminals and the first shielding shell are located in the first housing. The locking member has a plurality of locking portions. The locking portions protrude from an inner wall of a base portion of the locking member. The outer wall of the first housing has a plurality of convex portions and a plurality of guiding grooves formed between the convex portions. The locking member is movable to provide a self-locking function.

17 Claims, 9 Drawing Sheets

(56) References Cited

U.S. PATENT DOCUMENTS

| | | | | |
|---|---|---|---|---|
| 4,588,245 | A * | 5/1986 | Schwartz | H01R 13/622 439/312 |
| 5,637,010 | A * | 6/1997 | Jost | H01R 13/6277 439/352 |
| 6,722,705 | B2 * | 4/2004 | Korkor | A61M 39/1011 285/148.6 |
| 6,824,415 | B2 * | 11/2004 | Wlos | H01R 13/6276 439/348 |
| 7,575,450 | B2 * | 8/2009 | Williams | H01R 13/5219 439/144 |
| 7,744,383 | B2 * | 6/2010 | Da Silva | H01R 9/037 439/92 |
| 7,857,651 | B2 * | 12/2010 | Chen | H01R 13/5219 439/352 |
| 8,142,218 | B2 * | 3/2012 | Rudolph | H01R 13/627 439/357 |
| 8,944,839 | B2 * | 2/2015 | Pfeiffer | H01R 13/6275 439/352 |
| 9,478,904 | B2 * | 10/2016 | Ferry | H01R 13/6271 |
| 9,680,268 | B1 * | 6/2017 | Finona | H01R 24/38 |
| 2001/0005656 | A1 * | 6/2001 | Valceschini | H01R 13/5208 439/733.1 |
| 2014/0017928 | A1 * | 1/2014 | Shah | H01R 13/6277 439/350 |
| 2015/0126063 | A1 * | 5/2015 | Hannah | H01R 9/0518 439/585 |

* cited by examiner

HIGH-SPEED PUSH-PULL SELF-LOCK CONNECTOR AND CONNECTOR ASSEMBLY

CROSS-REFERENCE TO RELATED PATENT APPLICATION

This application claims the benefit of priority to China Patent Application No. 201811541360.7, filed on Dec. 17, 2018 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to a high-speed push-pull self-lock connector and a connector assembly which provide functions of self-locking and unlocking.

BACKGROUND OF THE DISCLOSURE

Conventional circular connectors are available for high-speed signal transmission. Some of the conventional circular connectors have self-locking mechanisms. When the circular connector having the self-locking mechanism is plugged with a dock connector, a self-locking effect can be achieved; and when the circular connector is separated from the dock connector, the circular connector can be smoothly unlocked. However, since the circular connector has the self-locking mechanism, it is no longer possible to provide a guiding mechanism, which makes it difficult to provide guidance for blind insertion.

In this regard, the present disclosure provides a high-speed push-pull self-lock connector and a connector assembly to overcome the aforementioned drawbacks.

SUMMARY OF THE DISCLOSURE

In response to the above-referenced technical inadequacies, the present disclosure provides a high-speed push-pull self-lock connector and a connector assembly which provide functions of self-locking, unlocking, and guiding so as to simplify the structure of the connector and facilitate assembly of the connector.

In one aspect, the present disclosure provides a high-speed push-pull self-lock connector including a first plastic core, a plurality of first terminals, a plurality of second terminals, a first shielding shell, a first housing, and a locking member. The first terminals are disposed through the first plastic core.

The second terminals are disposed through the first plastic core. The first shielding shell is disposed on the first plastic core. The first shielding shell covers and is disposed outside the first terminals and the second terminals. The first housing is disposed outside the first plastic core. The first terminals, the second terminals and the first shielding shell are respectively located in the first housing. The first housing has a plurality of convex portions. The convex portions are spaced apart from each other and are located on an outer wall of the first housing. The convex portions are close to a front end of the first housing. The first housing further has a plurality of guiding grooves formed between the convex portions, and the convex portions are arranged in a staggered manner with the guiding grooves. The locking member has a base portion and a plurality of locking portions. The locking portions are connected to the base portion, the locking portions are spaced apart from each other, the locking portions protrude from an inner wall of the base portion, one end of each of the locking portions away from the base portion forms a protrusion, and the protrusions respectively protrude from outer walls of the locking portions. The locking member is sleeved outside of the first housing, the locking portions of the locking member enable the locking portions and the guiding grooves to be offset from each other, and enable the locking member to be assembled to the first housing by guiding the locking portions into the guiding grooves and by rotating the locking member relative to the first housing. The locking member is capable of moving forward and backward along an axial direction of the first housing. When the locking member moves forward, the locking portions respectively abut against the convex portions to provide a self-locking function. When the locking member moves backward, the locking portions are respectively separated from the convex portions to provide an unlocking function.

In one aspect, the present disclosure provides a connector assembly including a high-speed push-pull self-lock connector as described above and a dock connector. The dock connector includes a second plastic core, a plurality of fourth terminals, a plurality of fifth terminals, a second shielding shell and a second housing. The fourth terminals and the fifth terminals are respectively disposed through the second plastic core, and the second shielding shell is disposed on the second plastic core. The second shielding shell covers and is disposed outside the fourth terminals and the fifth terminals. The second housing is disposed outside the second plastic core. The fourth terminals, the fifth terminals and the second shielding shell are respectively located in the second housing. The inner wall of the second housing has a plurality of concave grooves, the concave grooves are spaced apart from each other, and the concave grooves extend along an axial direction of the second housing. The inner wall of the second housing further has a fastening groove, and the fastening groove is circumferentially disposed on the inner wall of the second housing. When the high-speed push-pull self-lock connector is plugged with the dock connector, a front end of the high-speed push-pull self-lock connector is inserted into the dock connector, and the locking portions are respectively movable in the concave grooves to provide a guiding function. The first terminals and the second terminals are respectively in contact with the fourth terminals and the fifth terminals to achieve electrical connection. The protrusions of the locking portions are fastened to the fastening groove, and the convex portions respectively abut against the locking portions to provide the self-locking function. When the high-speed push-pull self-lock connector and the dock connector are ready to be separated from each other, the locking member is capable of being moved backward, such that the locking portions are respectively separated from the convex portions, and the protrusions of the locking portions are separated from the fastening groove to provide an unlocking function.

Therefore, the locking member of the present disclosure has a base portion and a plurality of locking portions. One end of each of the locking portions forms a protrusion. The first housing has a plurality of convex portions. The convex portions are spaced apart from each other and are located on the outer wall of the first housing. The first housing further has a plurality of guiding grooves formed between the convex portions. The convex portions are arranged in a staggered manner with the guiding grooves. Accordingly, the locking portions of the locking member enable the locking portions and the guiding grooves to be offset from each other, and enable the locking member to be assembled to the first housing by guiding the locking portions into the guiding grooves and by rotating the locking member relative to the first housing. The locking member can move forward and backward along an axial direction of the first housing to provide self-locking and unlocking functions. Moreover, when the high-speed push-pull self-lock connector is plugged with the dock connector, the locking portions are respectively movable in the concave grooves of the dock connector to provide guidance for blind insertion. The present disclosure integrates the functions of self-locking, unlocking, and guiding so as to simplify the structure of the connector and facilitate assembly of the connector.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
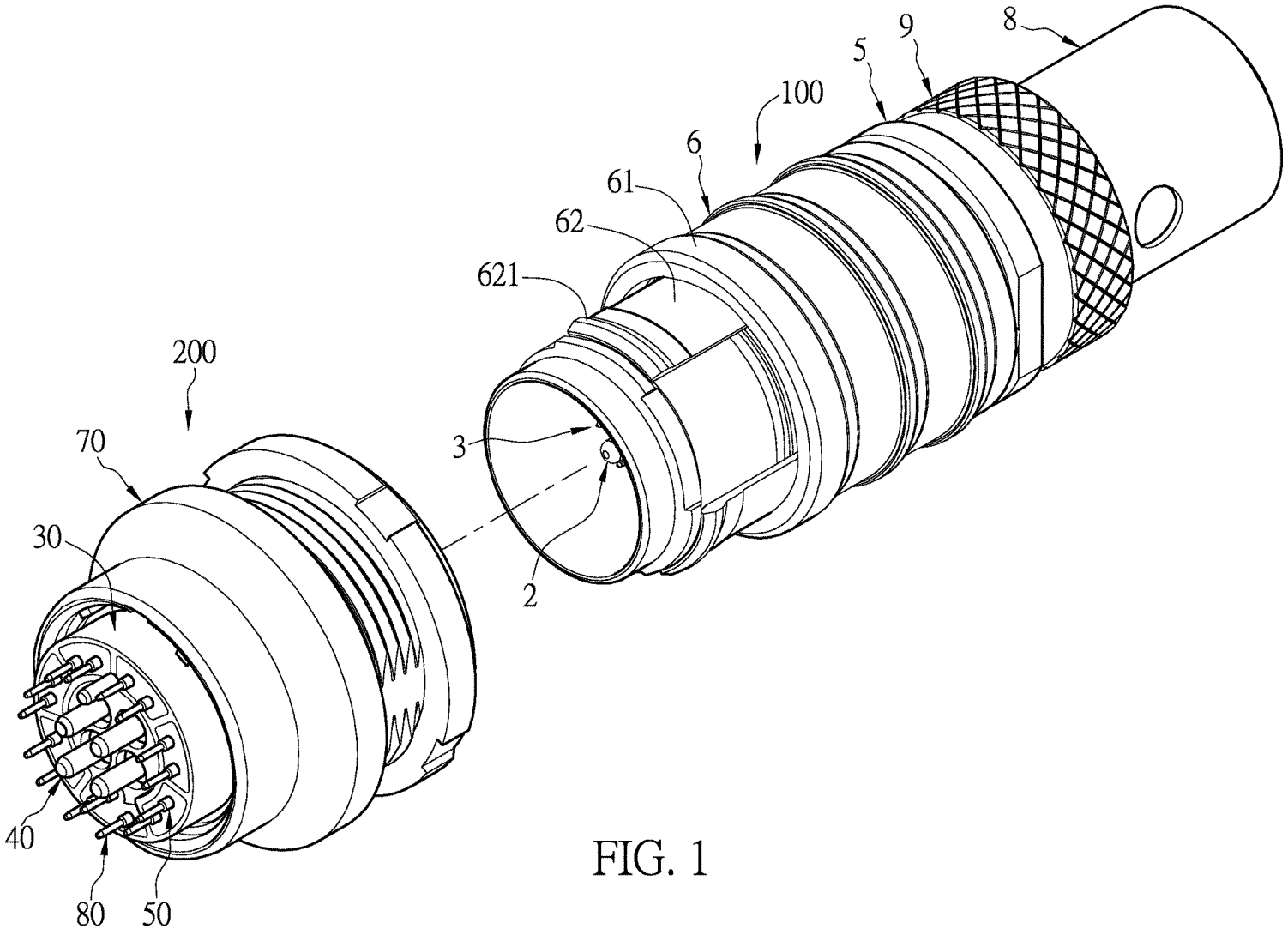
FIG. 1 is a perspective view of a connector assembly in a separated state according to an embodiment of the present disclosure.
Figure 2:
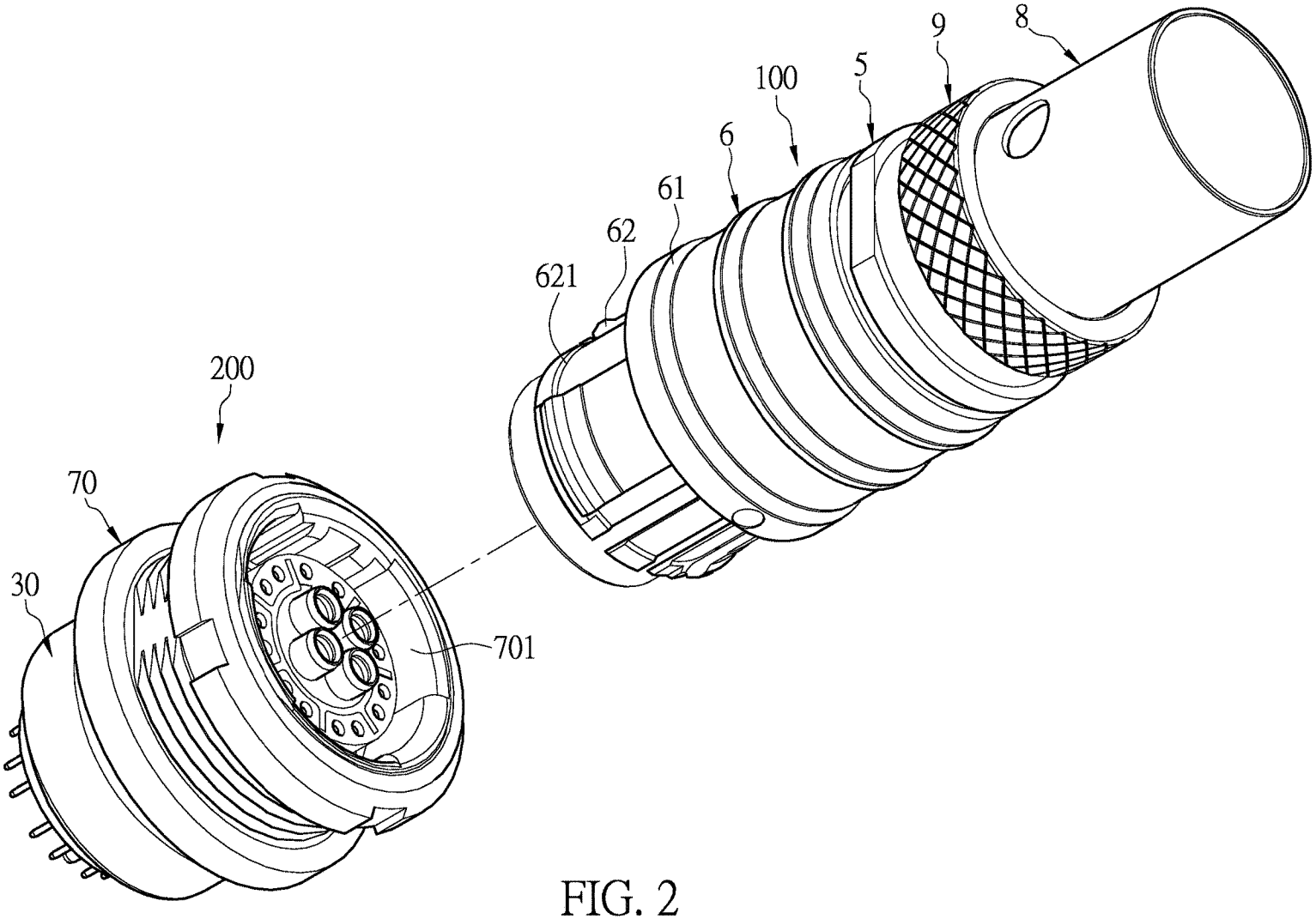
FIG. 2 is another perspective view of the connector assembly in the separated state according to the embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 4, an embodiment of the present disclosure provides a connector assembly. The connector assembly includes a high-speed push-pull self-lock connector 100 and a dock connector 200. The high-speed push-pull self-lock connector 100 and the dock connector 200 are circular connectors with shapes that correspond to each other. The high-speed push-pull self-lock connector 100 and the dock connector 200 can be respectively disposed at a line end and a board end. The high-speed push-pull self-lock connector 100 is detachably plugged with the dock connector 200.

Figure 5:
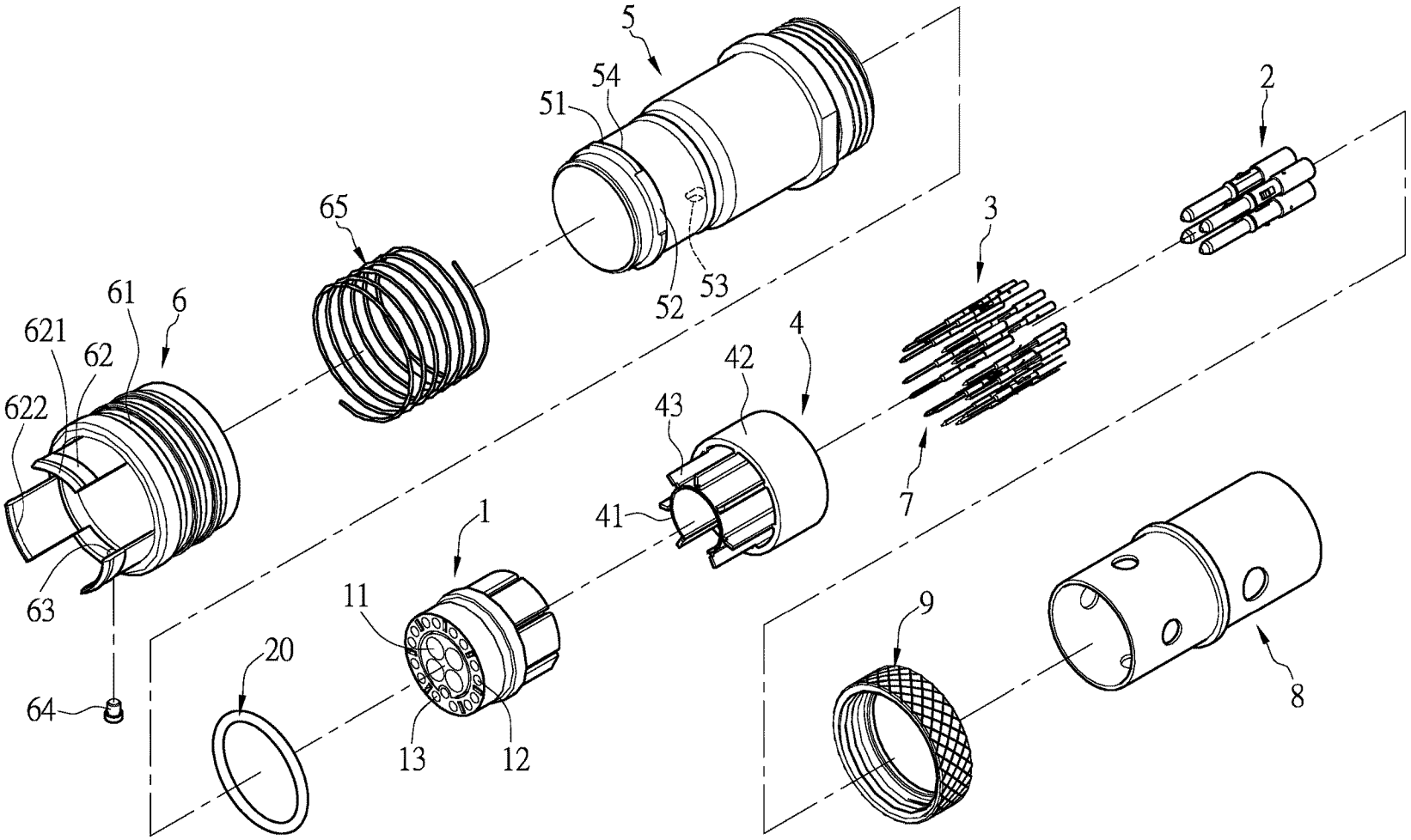
FIG. 5 is an exploded perspective view of a high-speed push-pull self-lock connector according to the embodiment of the present disclosure.
Figure 6:
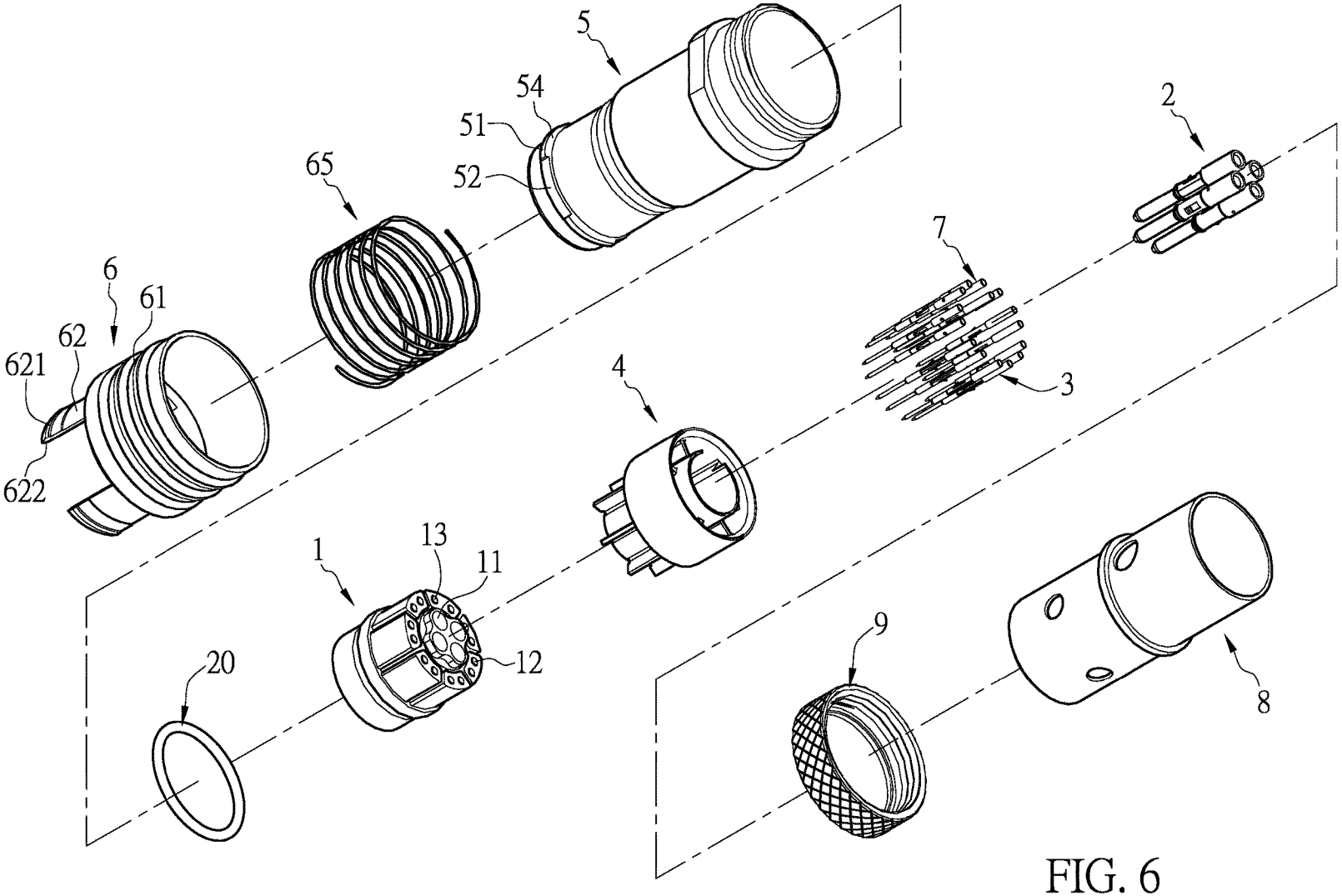
FIG. 6 is another exploded perspective view of the high-speed push-pull self-lock connector according to the embodiment of the present disclosure.

Referring to FIG. 5 and FIG. 6, the high-speed push-pull self-lock connector 100 includes a first plastic core 1, a plurality of first terminals 2, a plurality of second terminals 3, a first shielding shell 4, a first housing 5 and a locking member 6.

The first plastic core 1 is made of a plastic material and is an insulator. More specifically, the material of the first plastic core 1 may be a plastic material such as liquid-crystal polymer (LCP). The first plastic core 1 has a cylindrical shape. The first plastic core 1 has a plurality of first terminal holes 11 and a plurality of second terminal holes 12 to facilitate mounting of the first terminals 2 and the second terminals 3, respectively. The first terminal holes 11 are located near a center of the first plastic core 1. The second terminal holes 12 surround a periphery of the first terminal holes 11. The first terminal holes 11 and the second terminal holes 12 respectively extend along an axial direction of the first plastic core 1 and respectively penetrate through two opposite ends of the first plastic core 1.

The first terminals 2 and the second terminals 3 are made of a metal material with good electrical conductivity. The first terminals 2 and the second terminals 3 are respectively disposed through the first plastic core 1. The first terminals 2 can be used as low-speed transmission components such as power terminals. The second terminals 3 can be used as high-speed transmission components such as signal terminals. The first terminals 2 are respectively disposed through the first terminal holes 11, and the second terminals 3 are respectively disposed through the second terminal holes 12, such that the first terminals 2 and the second terminals 3 are respectively disposed through the first plastic core 1. The first terminals 2 are located near the center of the first plastic core 1, and the first terminals 2 are respectively equidistant from the center of the first plastic core 1. The second terminals 3 are close to an outer edge of the first plastic core 1, and the second terminals 3 are respectively equidistant from the center of the first plastic core 1. Preferably, a distance between each two adjacent second terminals 3 is 1.83 mm. The first terminals 2, the second terminals 3 and the first plastic core 1 can collectively form a modular design. The second terminals 3 (high frequency terminals) are annularly arranged on the first plastic core 1 and are equidistant from the center of the first plastic core 1, thereby reducing the volume of the connector and forming a matching of high-speed signals.

The first plastic core 1 may further have a plurality of third terminal holes 13. The third terminal holes 13 are respectively mounted with a plurality of third terminals 7 such that the third terminals 7 are disposed through the first plastic core 1. The third terminals 7 can serve as ground terminals, and the third terminals 7 are close to the outer edge of the first plastic core 1. The first terminals 2, the second terminals 3, and the third terminals 7 can be electrically connected to a cable.

The first shielding shell 4 is made of a metal material such as zinc, and the first shielding shell 4 is an integrally formed structure. The first shielding shell 4 is disposed on the first plastic core 1. The first shielding shell 4 covers and is disposed outside the first terminals 2, the second terminals 3 and the third terminals 7 to provide a better shielding effect. In the present embodiment, the first shielding shell 4 includes an inner shielding plate 41, an outer shielding plate 42 and a plurality of partition plates 43. The outer shielding plate 42 are spaced apart from an outer side of the inner shielding plate 41, and the partition plates 43 are disposed between the inner shielding plate 41 and the outer shielding plate 42. The inner shielding plate 41 covers and is disposed outside the first terminals 2. The outer shielding plate 42 covers and is disposed outside the second terminals 3. The partition plates 43 are respectively located between the second terminals 3.

Figure 9:
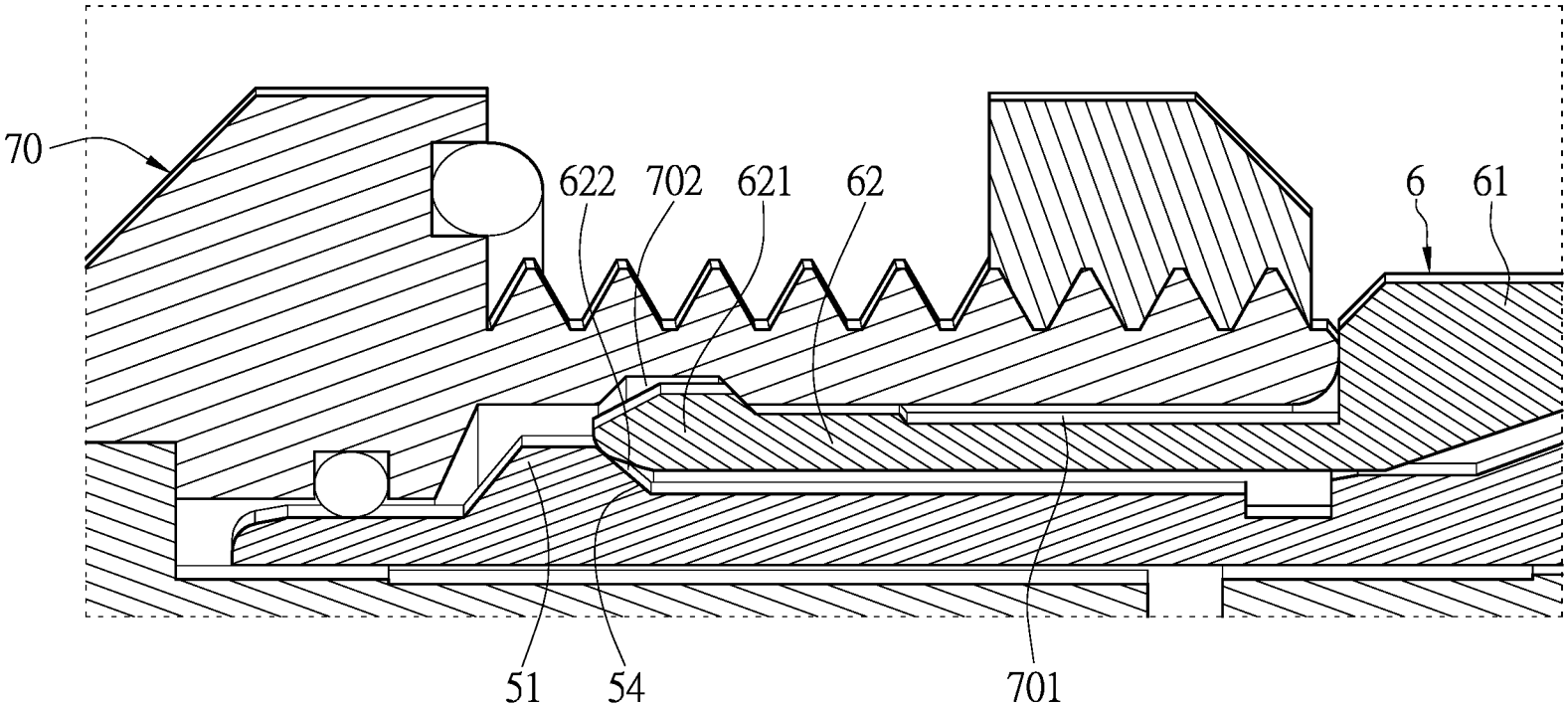
FIG. 9 is a partial enlarged view of region IX of FIG. 4.

The first housing 5 is made of a metal material, the first housing 5 is a cylindrical hollow body, and the first housing 5 is disposed outside the first plastic core 1. The first terminals 2, the second terminals 3, the third terminals 7 and the first shielding shell 4 are respectively located in the first housing 5. The first housing 5 has a plurality of convex portions 51. The number of the convex portions 51 is preferably three. The convex portions 51 are spaced apart from each other and are located on an outer wall of the first housing 5. The convex portions 51 are located near one end (i.e. the front end) of the first housing 5. One end (i.e. the rear end) of each of the convex portions 51 may have a first inclined surface 54 as shown in FIG. 9. The first housing 5 further has a plurality of guiding grooves 52 formed between the convex portions 51. The guiding grooves 52 are located on the outer wall of the first housing 5 and are equally spaced from each other. The convex portions 51 are arranged in a staggered manner with the guiding grooves 52.

The locking member 6 is made of a metal material, and the locking member 6 is an integrally formed structure. The locking member 6 has a base portion 61 and a plurality of locking portions 62. The base portion 61 is a cylindrical hollow body. The locking portions 62 are connected to the base portion 61, and the locking portions 62 are spaced apart from each other. The locking portions 62 can swing inwardly and outwardly, and the locking portions 62 protrude from an inner wall of the base portion 61. One end of each of the locking portions 62 away from the base portion 61 forms a protrusion 621, the protrusions 621 respectively protrude from outer walls of the locking portions 62, and an inner side of the end of each of the locking portions 62 away from the base portion 61 has a second inclined surface 622 as shown in FIG. 9.

The locking member 6 is sleeved outside of the first housing 5 from the front end of the first housing 5. The locking portions 62 of the locking member 6 can be positioned by guiding the locking portions 62 into the guiding grooves 52 and by rotating the locking member 6 relative to the first housing 5 via a predetermined angle (i.e. 60 degrees), such that the locking portions 62 and the guiding grooves 52 are offset from each other, and the locking member 6 is assembled to the first housing 5. The locking member 6 is movable along an axial direction (front-rear direction) of the first housing 5 to provide self-locking and unlocking functions In addition, the base portion 61 of the locking member 6 further has a fixing hole 63, and the fixing hole 63 is fixed with a positioning pin 64. The first housing 5 further has a sliding groove 53. The positioning pin 64 is slidably disposed in the sliding groove 53 and is configured to guide the locking member 6 to stably move backward and forward outside the first housing 5. When the locking member 6 moves forwardly, the locking portions 62 respectively abut against the convex portions 51 such that the locking portions 62 are fixed in position. That is, the second inclined surfaces 622 of the locking portions 62 respectively abut against the first inclined surfaces 54 of the convex portions 51 such that the locking portions 62 are fixed in position.

The high-speed push-pull self-lock connector 100 further includes a spring 65 disposed between the first housing 5 and the locking member 6. Two opposite ends of the spring 65 respectively abut against the first housing 5 and the locking member 6. The spring 65 is configured to absorb shock to prevent automatic unlocking. The spring 65 is configured to push the locking member 6 to move forward, such that the locking member 6 is fixed in position at a forward position under a normal state. That is, the spring 65 enables the convex portions 51 to respectively abut against the locking portions 62 to provide a locking (self-locking) function.

The high-speed push-pull self-lock connector 100 further includes a tube body 8, a tail cap 9 and a sealing member 20, which are disposed at a rear end of the first housing 5. The tube body 8 and the sealing member 20 are disposed in the first housing 5. The tube body 8 is configured to clamp the cable, the sealing member 20 is configured to increase the sealing effect, and the tail cap 9 is screwed to the first housing 5 to forcibly fix the tube body 8.

As described above, the locking member 6 of the present embodiment has a base portion 61 and a plurality of locking portions 62. The locking portions 62 are spaced apart from each other, and the locking portions 62 protrude from the inner wall of the base portion 61. One end of each of the locking portions 62 forms a protrusion 621. The first housing 5 has a plurality of convex portions 51. The convex portions 51 are spaced apart from each other and are located on the outer wall of the first housing 5. The first housing 5 further has a plurality of guiding grooves 52 formed between the convex portions 51. The convex portions 51 are arranged in a staggered manner with the guiding grooves 52. Accordingly, the locking portions 62 of the locking member 6 can be positioned by guiding the locking portions 62 into the guiding grooves 52 and by rotating the locking member 6 relative to the first housing 5 via a predetermined angle, such that the locking member 6 is assembled to the first housing 5. The locking member 6 can move forward and backward along an axial direction of the first housing 5 to provide self-locking and unlocking functions.

Figure 7:
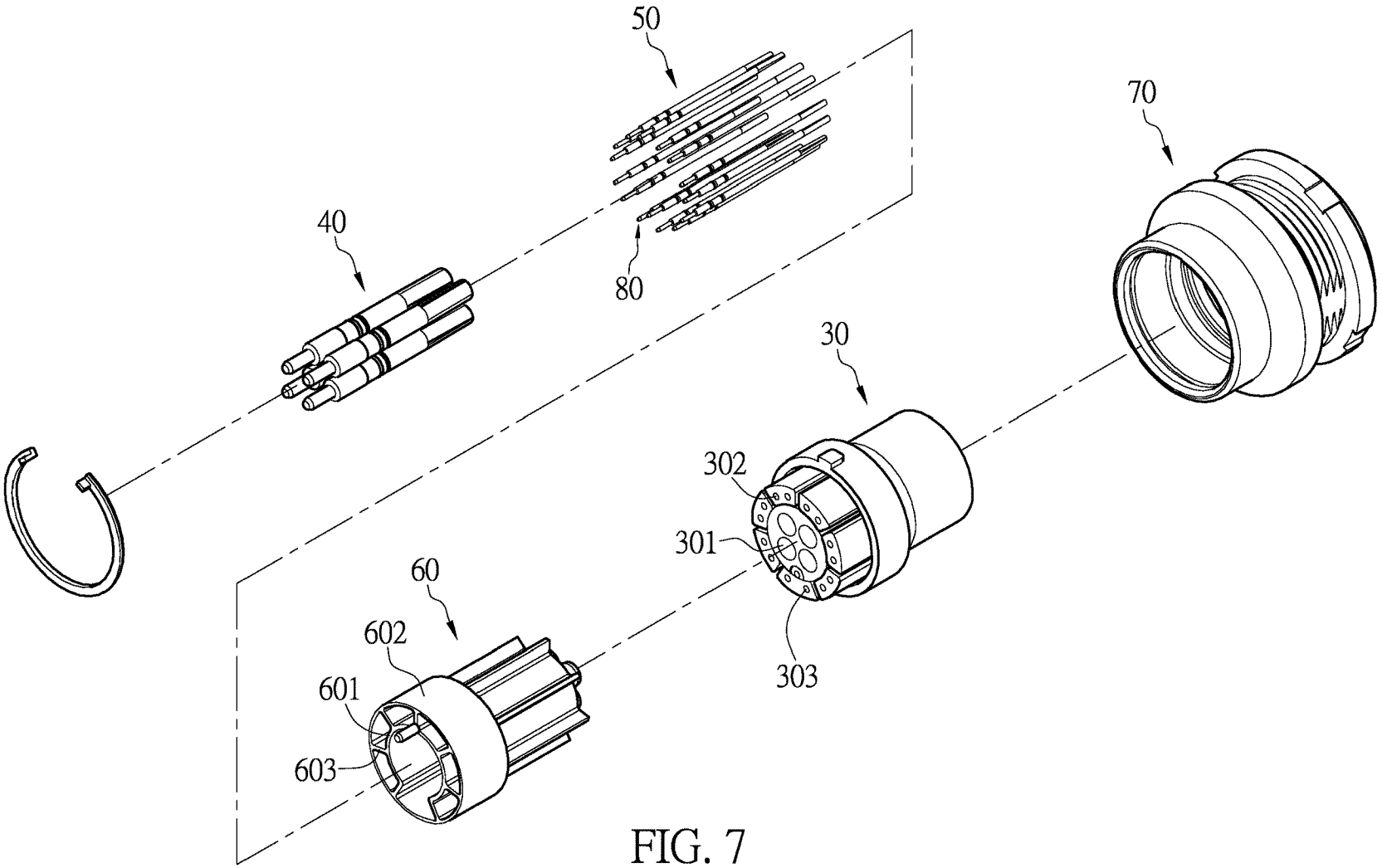
FIG. 7 is an exploded perspective view of a dock connector according to the embodiment of the present disclosure.
Figure 8:
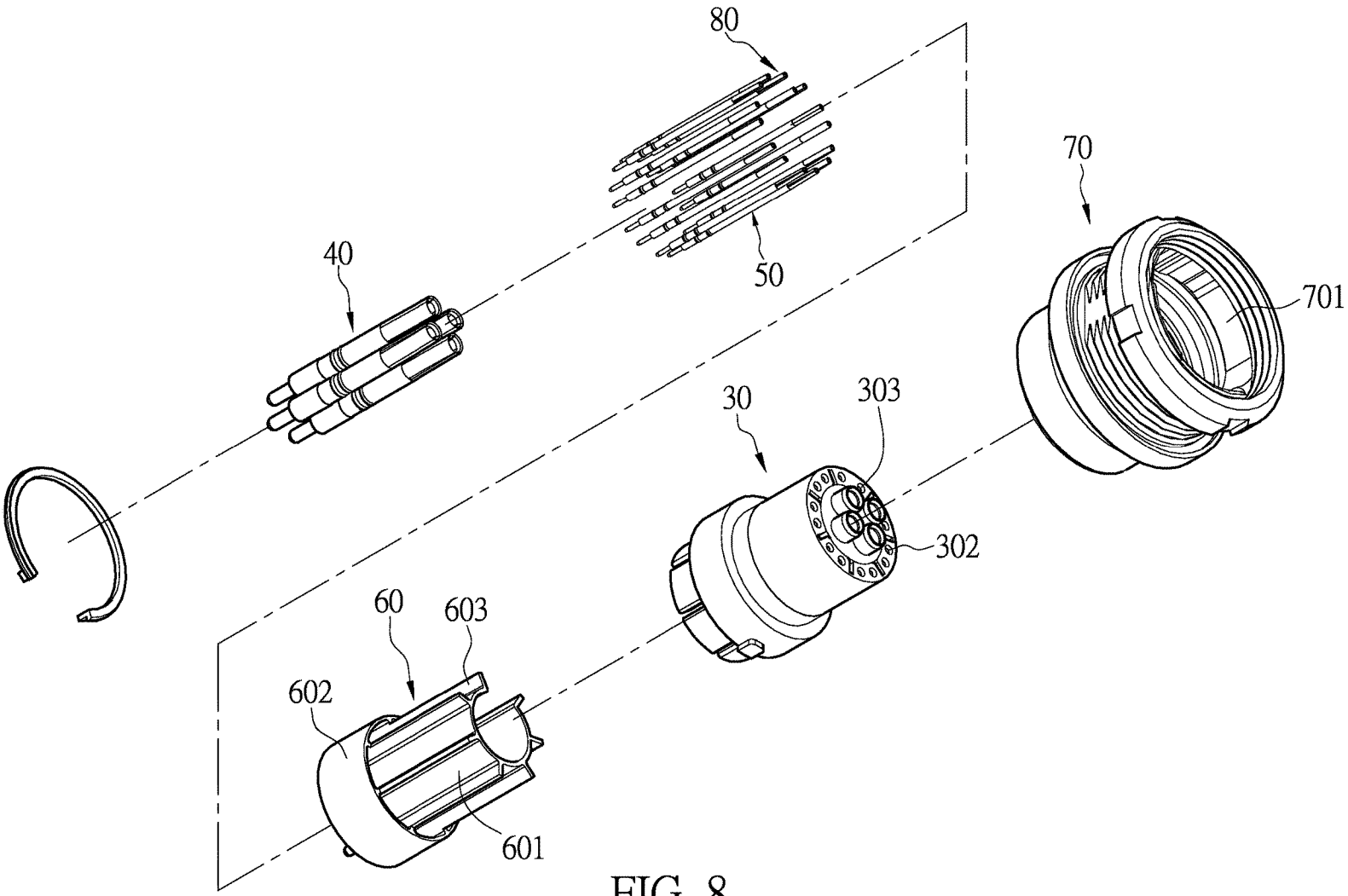
FIG. 8 is another exploded perspective view of a dock connector according to the embodiment of the present disclosure.

Referring to FIG. 7 and FIG. 8, the dock connector 200 includes a second plastic core 30, a plurality of fourth terminals 40, a plurality of fifth terminals 50, a second shielding shell 60 and a second housing 70.

The second plastic core 30 is made of a plastic material and is an insulator. More specifically, the material of the second plastic core 30 may be a plastic material such as LCP. The second plastic core 30 has a cylindrical shape. The second plastic core 30 has a plurality of fourth terminal holes 301 and a plurality of fifth terminals 302 to facilitate mounting of the fourth terminals 40 and the fifth terminals 50, respectively.

The fourth terminals 40 and the fifth terminals 50 are made of a metal material with good electrical conductivity. The fourth terminals 40 and the fifth terminals 50 are respectively disposed through the second plastic core 30. The fourth terminals 40 can be used as low-speed transmission components such as power terminals. The fifth terminals 50 can be used as high-speed transmission components such as signal terminals. The fourth terminals 40 are respectively disposed through the fourth terminal holes 301, and the fifth terminals 50 are respectively disposed through the fifth terminal holes 302, such that the fourth terminals 40 and the fifth terminals 50 are respectively disposed through the second plastic core 30. The fourth terminals 40 are located near the center of the second plastic core 30, and the fourth terminals 40 are respectively equidistant from the center of the second plastic core 30. The fifth terminals 50 are close to an outer edge of the second plastic core 30, and the fifth terminals 50 are respectively equidistant from the center of the second plastic core 30. Preferably, the distance between each two adjacent ones of the fifth terminals 50 is 1.83 mm. The fourth terminals 40, the fifth terminals 50 and the second plastic core 30 can collectively form a modular design. The fifth terminals 50 (high frequency terminals) are annularly arranged on the second plastic core 30 and are equidistant from the center of the second plastic core 30, thereby reducing the volume of the device and forming a matching of high-speed signals.

The second plastic core 30 may further have a plurality of sixth terminal holes 303. The sixth terminal holes 303 are respectively mounted with a plurality of sixth terminals 80 such that the sixth terminals 80 are disposed through the second plastic core 30. The sixth terminals 80 can serve as ground terminals, and the sixth terminals 80 are close to the outer edge of the second plastic core 30. The fourth terminals 40, the fifth terminals 50, and the sixth terminals 80 can be electrically connected to a circuit board.

The second shielding shell 60 is made of a metal material such as zinc, and the second shielding shell 60 is an integrally formed structure. The second shielding shell 60 is disposed on the second plastic core 30. The second shielding shell 60 covers and is disposed outside the fourth terminals 40, the fifth terminals 50, and the sixth terminals 80 to provide a better shielding effect. In the present embodiment, the second shielding shell 60 includes an inner shielding sheet 601, an outer shielding sheet 602 and a plurality of partition sheets 603. The outer shielding sheet 602 are spaced apart from an outer side of the inner shielding sheet 601, and the partition sheets 603 are disposed between the inner shielding sheet 601 and the outer shielding sheet 602. The inner shielding sheet 601 covers and is disposed outside the fourth terminals 40. The outer shielding sheet 602 covers and is disposed outside the fifth terminals 50. The partition sheets 603 are respectively located between the fifth terminals 50.

The second housing 70 is made of a metal material, the second housing 70 is a cylindrical hollow body, and the second housing 70 is disposed outside the second plastic core 30. The fourth terminals 40, the fifth terminals 50, the sixth terminals 80 and the second shielding shell 60 are respectively located in the second housing 70. The inner wall of the second housing 70 has a plurality of concave grooves 701, the concave grooves 701 extend along an axial direction of the second housing 70, and the concave grooves 701 are spaced apart from each other. The concave grooves 701 respectively correspond to the locking portions 62, and the concave grooves 701 are configured to guide the locking portions 62 to be inserted therein, such that the high-speed push-pull self-lock connector 100 can be smoothly inserted into the dock connector 200 to facilitate blind insertion. The inner wall of the second housing 70 further has a fastening groove 702. The fastening groove 702 is circumferentially disposed on the inner wall of the second housing 70, and the fastening groove 702 allows the protrusions 621 of the locking portions 62 to be fastened thereto.

Figure 3:
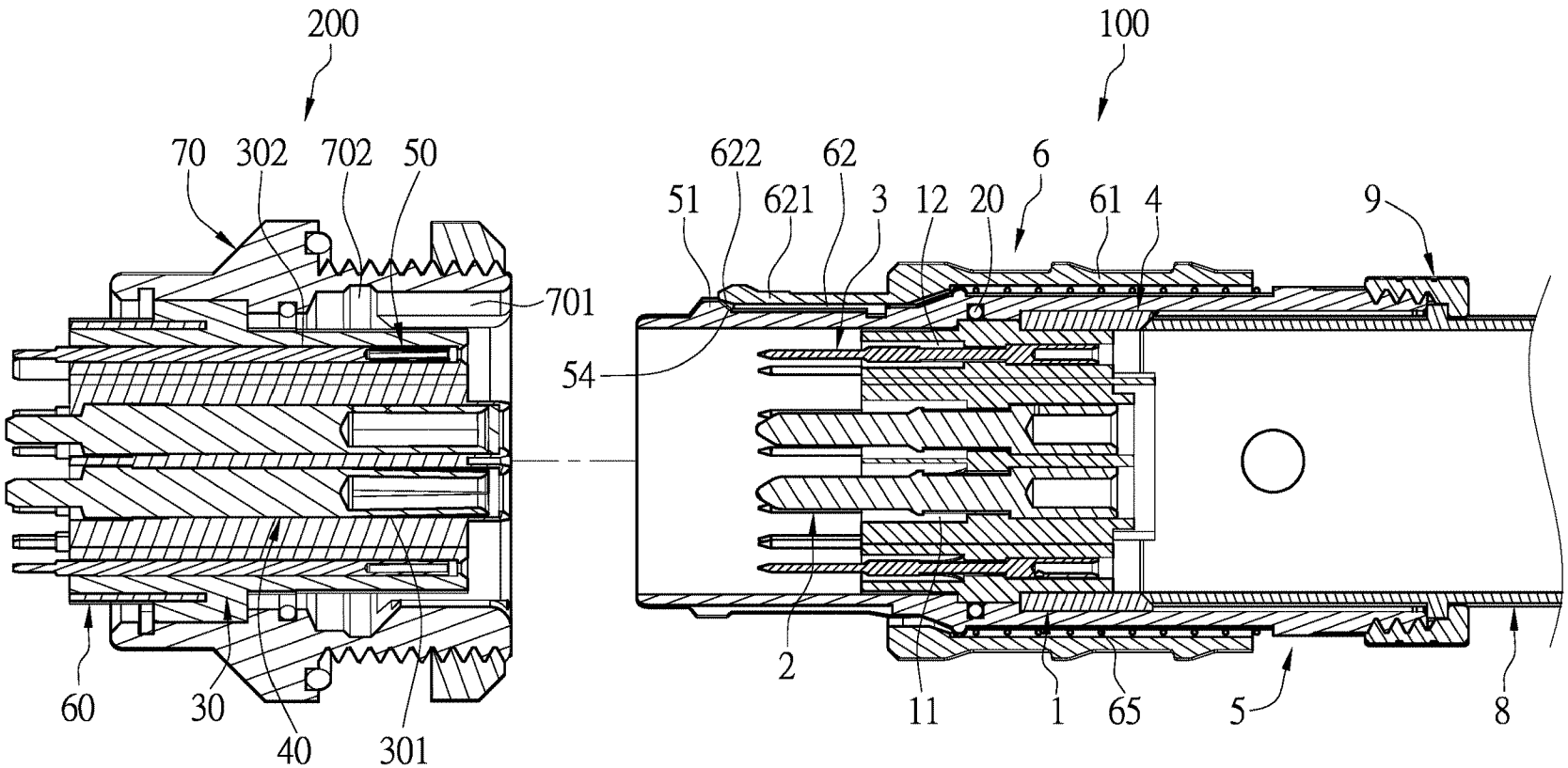
FIG. 3 is a cross-sectional view of the connector assembly in the separated state according to the embodiment of the present disclosure.
Figure 4:
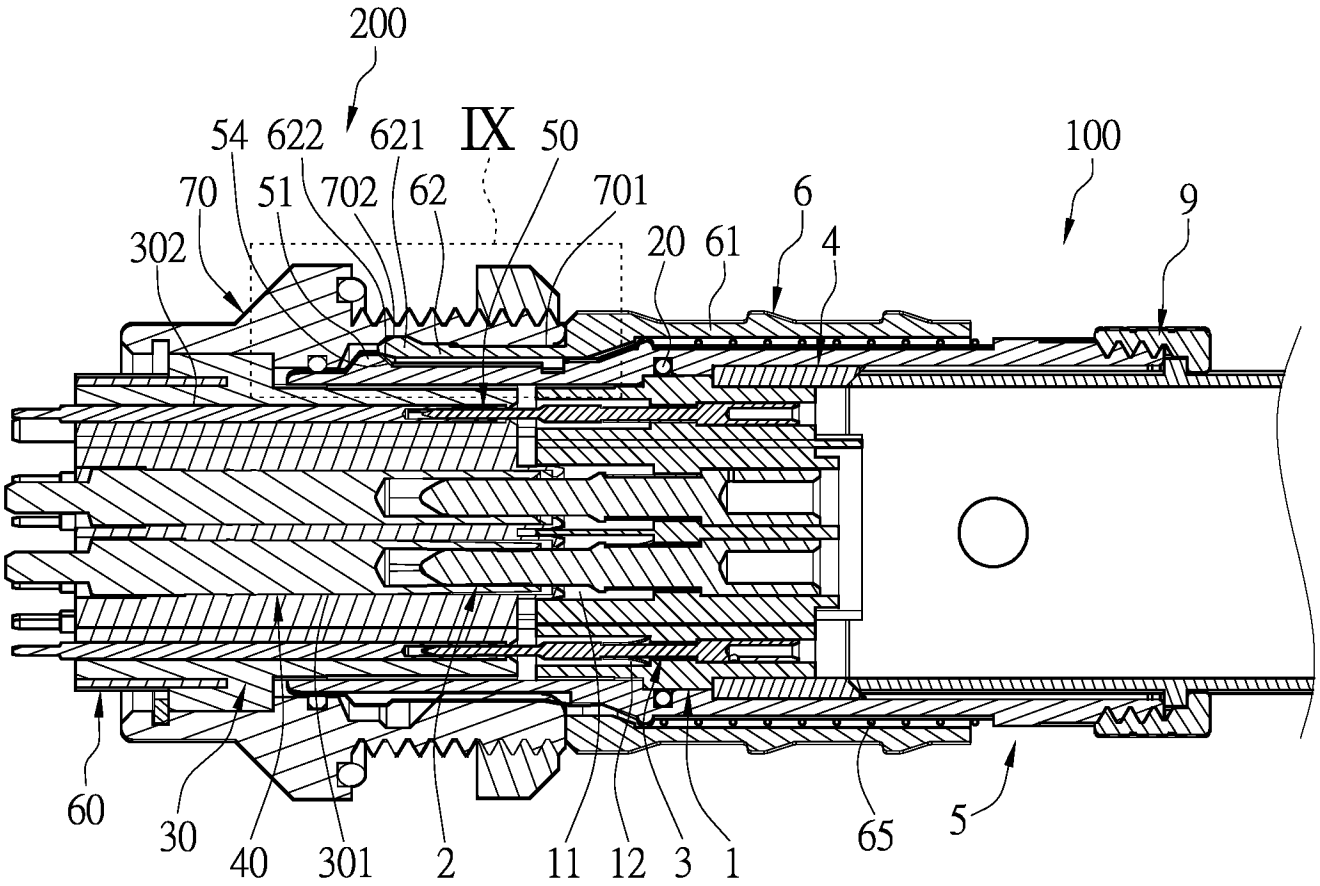
FIG. 4 is a cross-sectional view of the connector assembly in an assembled state according to the embodiment of the present disclosure.

Referring to FIG. 3 and FIG. 4, when the high-speed push-pull self-lock connector 100 is plugged with the dock connector 200, a front end of the high-speed push-pull self-lock connector 100 is inserted into the dock connector 200, such that the first terminals 2, the second terminals 3, and the third terminals 7 are respectively in contact with the fourth terminals 40, the fifth terminals 50, and the sixth terminals 80 to achieve electrical connection. When the high-speed push-pull self-lock connector 100 is inserted into the dock connector 200, the locking portions 62 are respectively movable in the concave grooves 701 to provide functions of guiding and blind insertion. When the high-speed push-pull self-lock connector 100 is inserted into the dock connector 200 to a predetermined position, the protrusions 621 of the locking portions 62 are fastened to the fastening groove 702 (as shown in FIG. 9), and the convex portions 51 respectively abut against the locking portions 62. That is, the first inclined surfaces 54 of the convex portions 51 respectively abut against the second inclined surfaces 622 of the locking portions 62, such that the locking portions 62 cannot swing to provide the locking (self-locking) function. When the high-speed push-pull self-lock connector 100 and the dock connector 200 are ready to be separated from each other, the locking member 6 can be moved backward such that the locking member 6 is in a backward position. Accordingly, the locking portions 62 are respectively separated from the convex portions 51, the locking portions 62 can swing freely, such that the protrusions 621 of the locking portions 62 can be disengaged from the fastening groove 702 to provide an unlocking function.

In conclusion, the locking member of the present disclosure has a base portion and a plurality of locking portions. One end of each of the locking portions forms a protrusion. The first housing has a plurality of convex portions. The convex portions are spaced apart from each other and are located on the outer wall of the first housing. The first housing further has a plurality of guiding grooves formed between the convex portions. The convex portions are arranged in a staggered manner with the guiding grooves. Accordingly, the locking portions of the locking member can be positioned by guiding the locking portions into the guiding grooves and by rotating the locking member relative to the first housing via a predetermined angle, such that the locking member is assembled to the first housing. The locking member can move forward and backward along an axial direction of the first housing to provide self-locking and unlocking functions. Moreover, when the high-speed push-pull self-lock connector is plugged with the dock connector, the locking portions are respectively movable in the concave grooves of the dock connector to provide guidance for blind insertion. The present disclosure integrates the functions of self-locking, unlocking, and blind insertion so as to simplify the structure of the connector and facilitate assembly of the connector.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A high-speed push-pull self-lock connector, comprising:

a first plastic core;

a plurality of first terminals being disposed through the first plastic core;

a plurality of second terminals being disposed through the first plastic core;

a first shielding shell being disposed on the first plastic core; wherein the first shielding shell covers and is disposed outside the first terminals and the second terminals;

a first housing being disposed outside the first plastic core; wherein the first terminals, the second terminals and the first shielding shell are respectively located in the first housing; the first housing has a plurality of convex portions; the convex portions are spaced apart from each other and are located on an outer wall of the first housing; the convex portions are close to a front end of the first housing; wherein the first housing further has a plurality of guiding grooves formed between the convex portions, and the convex portions are arranged in a staggered manner with the guiding grooves; and a locking member having a base portion and a plurality of locking portions; wherein the locking portions are connected to the base portion, the locking portions are spaced apart from each other, the locking portions protrude from an inner wall of the base portion, one end of each of the locking portions away from the base portion forms a protrusion, and the protrusions respectively protrude from outer walls of the locking portions; wherein the locking member is sleeved outside of the first housing, the locking portions of the locking member enable the locking portions and the guiding grooves to be offset from each other, and enable the locking member to be assembled to the first housing by guiding the locking portions into the guiding grooves and by rotating the locking member relative to the first housing; wherein the locking member is capable of moving forward and backward along an axial direction of the first housing; when the locking member moves forward, the locking portions respectively abut against the convex portions to provide a self-locking function; and when the locking member moves backward, the locking portions are respectively separated from the convex portions to provide an unlocking function.

2. The high-speed push-pull self-lock connector according to claim 1, wherein the first plastic core has a cylindrical shape, the first terminals are located near a center of the first plastic core, and the first terminals are respectively equidistant from the center of the first plastic core; the second terminals are located near an outer edge of the first plastic core, and the second terminals are respectively equidistant from the center of the first plastic core.

3. The high-speed push-pull self-lock connector according to claim 2, wherein the first terminals are power terminals, the second terminals are signal terminals, and a distance between each two adjacent second terminals is 1.83 mm.

4. The high-speed push-pull self-lock connector according to claim 1, wherein the first shielding shell is an integrally formed structure; the first shielding shell includes an inner shielding plate, an outer shielding plate and a plurality of partition plates; the outer shielding plate are spaced apart from an outer side of the inner shielding plate, and the partition plates are disposed between the inner shielding plate and the outer shielding plate; the inner shielding plate covers and is disposed outside the first terminals, the outer shielding plate covers and is disposed outside the second terminals, and the partition plates are respectively located between the second terminals.

5. The high-speed push-pull self-lock connector according to claim 1, wherein a rear end of each of the convex portions has a first inclined surface, and an inner side of the end of each of the locking portions away from the base portion has a second inclined surface; when the locking member moves forward, the second inclined surfaces of the locking portions respectively abut against the first inclined surfaces of the convex portions such that the locking portions are fixed in position.

6. The high-speed push-pull self-lock connector according to claim 1, wherein the base portion of the locking member further has a fixing hole, and the fixing hole is fixed with a positioning pin; the first housing further has a sliding groove, and the positioning pin is slidably disposed in the sliding groove and is configured to guide the locking member to stably move backward and forward outside the first housing.

7. The high-speed push-pull self-lock connector according to claim 1, further comprising a spring that is disposed between the first housing and the locking member, wherein two opposite ends of the spring respectively abut against the first housing and the locking member, and the spring is configured to push the locking member to move forward, such that the convex portions respectively abut against the locking portions.

8. A connector assembly, comprising:

a high-speed push-pull self-lock connector as claimed in claim 1; and a dock connector including a second plastic core, a plurality of fourth terminals, a plurality of fifth terminals, a second shielding shell and a second housing;

wherein the fourth terminals and the fifth terminals are respectively disposed through the second plastic core, and the second shielding shell is disposed on the second plastic core; the second shielding shell covers and is disposed outside the fourth terminals and the fifth terminals; the second housing is disposed outside the second plastic core; the fourth terminals, the fifth terminals and the second shielding shell are respectively located in the second housing; an inner wall of the second housing has a plurality of concave grooves, the concave grooves are spaced apart from each other, and the concave grooves extend along an axial direction of the second housing; and the inner wall of the second housing further has a fastening groove, and the fastening groove is circumferentially disposed on the inner wall of the second housing;

wherein when the high-speed push-pull self-lock connector is plugged with the dock connector, a front end of the high-speed push-pull self-lock connector is inserted into the dock connector, and the locking portions are respectively movable in the concave grooves to provide a guiding function; the first terminals and the second terminals are respectively in contact with the fourth terminals and the fifth terminals to achieve electrical connection; the protrusions of the locking portions are fastened to the fastening groove, and the convex portions respectively abut against the locking portions to provide a self-locking function; and when the high-speed push-pull self-lock connector and the dock connector are ready to be separated from each other, the locking member is capable of being moved backward, such that the locking portions are respectively separated from the convex portions, and the protrusions of the locking portions are separated from the fastening groove to provide an unlocking function.

9. The connector assembly according to claim 8, wherein the fourth terminals are located near a center of the second plastic core, and the fourth terminals are respectively equidistant from the center of the second plastic core; the fifth terminals are close to an outer edge of the second plastic core, and the fifth terminals are respectively equidistant from the center of the second plastic core.

10. The connector assembly according to claim 9, wherein the distance between each two adjacent fifth terminals is 1.83 mm.

11. The connector assembly according to claim 8, wherein the second shielding shell includes an inner shielding sheet, an outer shielding sheet and a plurality of partition sheets; the outer shielding sheet is spaced apart from an outer side of the inner shielding sheet, and the partition sheets are disposed between the inner shielding sheet and the outer shielding sheet; the inner shielding sheet covers and is disposed outside the fourth terminals, the outer shielding sheet covers and is disposed outside the fifth terminals, and the partition sheets are respectively located between the fifth terminals.

12. The connector assembly according to claim 8, wherein the first plastic core has a cylindrical shape, the first terminals are located near a center of the first plastic core, and the first terminals are respectively equidistant from the center of the first plastic core; the second terminals are located near an outer edge of the first plastic core, and the second terminals are respectively equidistant from the center of the first plastic core.

13. The connector assembly according to claim 12, wherein the first terminals are power terminals, the second terminals are signal terminals, and a distance between each two adjacent second terminals is 1.83 mm.

14. The connector assembly according to claim 8, wherein the first shielding shell is an integrally formed structure; the first shielding shell includes an inner shielding plate, an outer shielding plate and a plurality of partition plates; the outer shielding plate is spaced apart from an outer side of the inner shielding plate, and the partition plates are disposed between the inner shielding plate and the outer shielding plate; the inner shielding plate covers and is disposed outside the first terminals, the outer shielding plate covers and is disposed outside the second terminals, and the partition plates are respectively located between the second terminals.

15. The connector assembly according to claim 8, wherein a rear end of each of the convex portions has a first inclined surface, and an inner side of the end of each of the locking portions away from the base portion has a second inclined surface; and when the locking member moves forward, the second inclined surfaces of the locking portions respectively abut against the first inclined surfaces of the convex portions such that the locking portions are fixed in position.

16. The connector assembly according to claim 8, wherein the base portion of the locking member further has a fixing hole, and the fixing hole is fixed with a positioning pin; the first housing further has a sliding groove, and the positioning pin is slidably disposed in the sliding groove and is configured to guide the locking member to stably move backward and forward outside the first housing.

17. The connector assembly according to claim 8, further comprising a spring that is disposed between the first housing and the locking member, two opposite ends of the spring respectively abutting against the first housing and the locking member, and the spring being configured to push the locking member to move forward, such that the convex portions respectively abut against the locking portions.

* * * * *